US005449327A

United States Patent [19]

Heddon et al.

[11] Patent Number: 5,449,327

[45] Date of Patent: * Sep. 12, 1995

[54] BOWLING BALL RETURN SYSTEMS AND METHODS

[75] Inventors: Will Heddon, Lake Wales; Robert S. Hagen, Orlando; Bruce M. McPherson, Maitland, all of Fla.

[73] Assignee: Heddon Bowling Corporation, Lake Hamilton, Fla.

[ * ] Notice: The portion of the term of this patent subsequent to Mar. 8, 2011 has been disclaimed.

[21] Appl. No.: 32,930

[22] Filed: Mar. 18, 1993

Related U.S. Application Data

[63] Continuation-in-part of Ser. No. 940,238, Sep. 3, 1992, Pat. No. 5,292,121.

[51] Int. Cl.[6] ..... A63D 5/02

[52] U.S. Cl. ..... 473/110; 473/111; 273/182 R; 273/179 D

[58] Field of Search ..... 273/179 D, 47, 48, 49, 273/122 R, 122 A, 125 R, 125 A, 129 AP; 29/DIG. 78

[56] References Cited

U.S. PATENT DOCUMENTS

| | | | |
|---|---|---|---|
| 1,885,662 | 11/1932 | Whitehorn . | |
| 1,931,841 | 10/1933 | Evans | 273/179 D |
| 1,987,000 | 1/1935 | Cahill | 273/47 |
| 2,247,787 | 7/1941 | Schmidt . | |
| 3,015,489 | 1/1962 | Jones et al. | 273/47 |
| 3,260,527 | 7/1966 | Younce | 273/179 D |
| 3,599,980 | 8/1971 | Harmond | 273/176 A |
| 3,711,038 | 1/1973 | Van Otteren . | |
| 4,272,078 | 6/1981 | Vinette | 273/182 R |
| 4,801,143 | 1/1989 | Heddon | 473/110 |
| 4,984,939 | 1/1991 | Foreman et al. | 406/84 |

*Primary Examiner*—Vincent Millin
*Assistant Examiner*—William M. Pierce
*Attorney, Agent, or Firm*—Allen, Dyer, Doppelt, Franjola & Milbrath

[57] ABSTRACT

Bowling balls are returned from the pit area of a bowling alley to a return shroud through a vacuum tube into a lift tube. A transporter assembly is contained within the shroud for decelerating the bowling balls. The shroud includes continuous rails for permitting a high volume of bowling ball storage. In order to reduce the area required for spacing between adjacent bowling alleys, the vacuum tube is installed underneath the plane of the alleys, with the bowling balls fed into the vacuum tube via a vertical tube extending upwardly behind the pin-setting equipment located in the pit area.

12 Claims, 6 Drawing Sheets

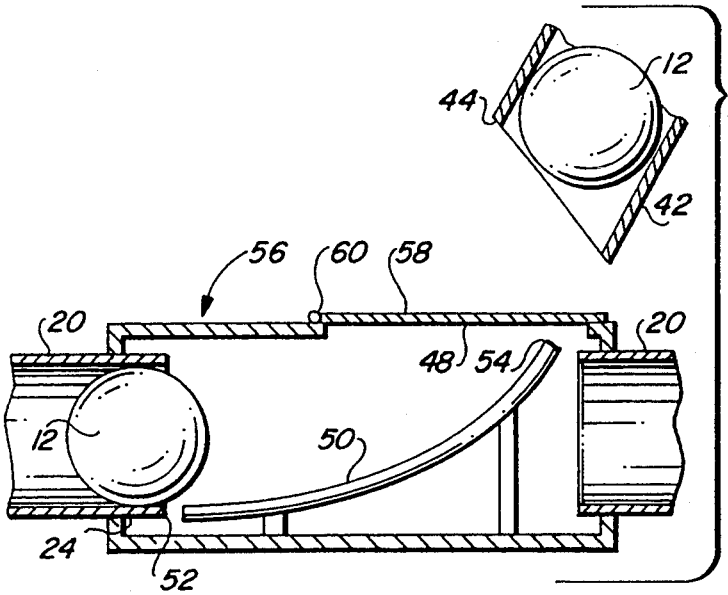
FIG. 5
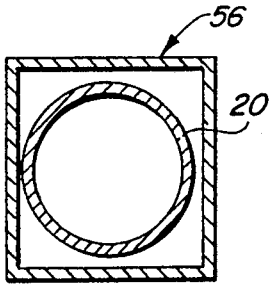
FIG. 6
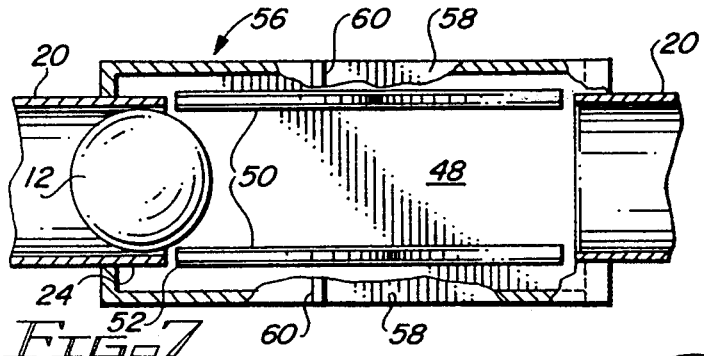
FIG. 7
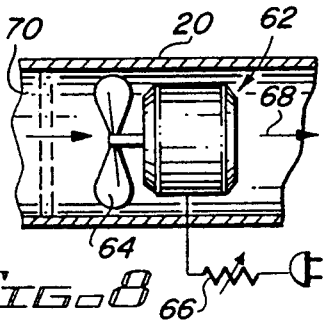
FIG. 8
FIG. 3
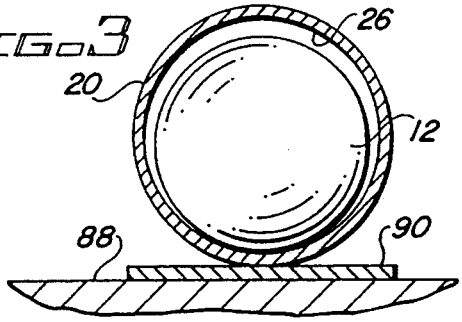
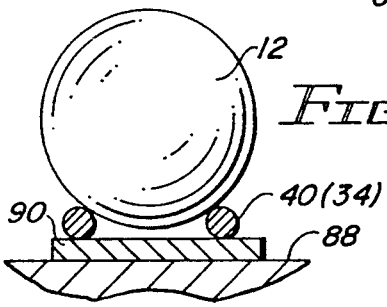
FIG. 4
FIG. 9
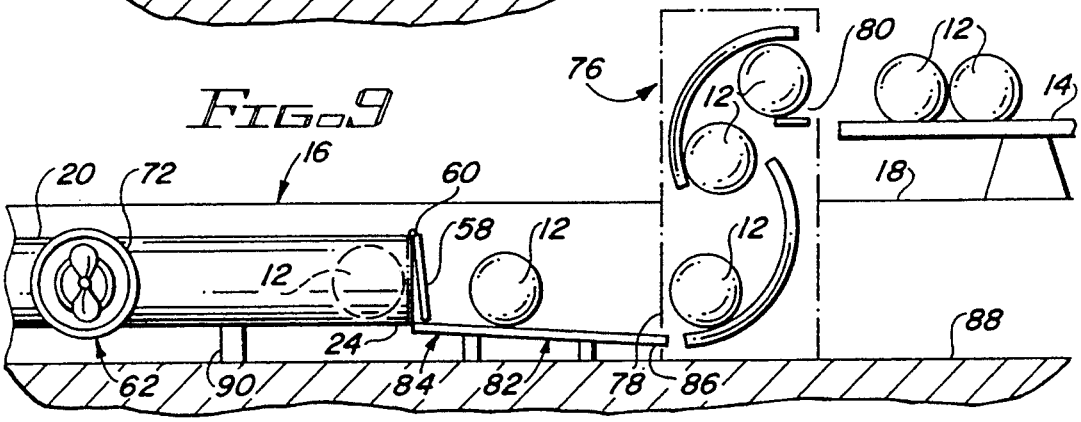

BOWLING BALL RETURN SYSTEMS AND METHODS

This application is a continuation-in-part of co-pending application Ser. No. 07/940,238 filed on Sep. 3, 1992, now U.S. Pat. No. 5,292,121.

BACKGROUND OF THE INVENTION

1. Field of the Invention

The invention relates to bowling ball return systems and methods.

2. Background Art

The ancient game of bowling has seen much in the evolution of the methods and devices used to return the a bowling ball to the bowler after the bowling ball has been used to knock down bowling pins. Many of the methods used manually by human pin setters were carried over to mechanical devices. One such device includes a mechanical arm that lifts the bowling ball to a track elevated above the bowling alley in the pit area. The bowling ball builds up momentum and therefore speed by rolling down the inclined track to a level track running along side and usually below the alley to the approach or player's area. The elevation of the inclined track needed to be high enough to provide initial speed to the bowling ball so that it could reach the ball storage racks located above the alley at the approach end of the alley. To assist the bowling ball in rolling up the inclined plane to the ball storage rack, wheel and belt devices were devised to impart sufficient added momentum to the ball to allow it to roll up the inclined plane to the storage rack.

U.S. Pat. No. 1,987,000 (Bowling Alley) issued Jan. 8, 1935 to G. F. Cahill discloses as one of the objectives of the invention to accelerate the return of the bowling ball from the pin or pit end of the alley to the approach or player's end of the alley and in particular to enable the bowling ball to climb to the elevated player's end, which is elevated above the pit end of the alley. Various devices are disclosed for use in accelerating the bowling ball using wheels and belts in contact with the bowling ball.

U.S. Pat. No. 2,247,787 (Suction Lifter) issued on Jul. 1, 1941 to G. J. Schmidt discloses a transfer mechanism comprising a suction head provided with a vacuum and motor controlled assembly that can lift and relocate a bowling ball from one position to another, and is used to relocate a bowling ball from a pit area to an elevated track for its initial acceleration from the pit area to the approach area. In addition, this system could be configured to relocate the bowling ball from a location on the track below the alley to a ball storage rack located above the alley.

In typical bowling ball return systems, the bowling ball is accelerated from the pit area by the various methods discussed. The bowling ball is accelerated only to the point where it can reach a location below the approach area. The bowling ball is then fed into a power lift assembly which carries the bowling ball upward into the ball storage rack. The lift assembly is housed in a ball lift hood to conceal it from the player's view. There are inherent problems associated with these typical return devices that include the need to stop operations because balls of varying weights have traveled at various speeds and have become jammed in the return or at the power lift.

The use of track to transport the bowling ball from the pit area to the approach area of a bowling alley has seen extensive use. The use of track to transport a sphere in general has been disclosed in various arts as seen in U.S. Pat. No. 1,885,662 (Electric Railway System) issued on Nov. 1, 1932 to H. K. Whitehorn. Whitehorn discloses a sphere being transported over a two rail system as well as a tube.

Pneumatic tube transmission systems have been employed to transport containers. U.S. Pat. No. 4,984,939 (Pneumatic Tube Transmission System With Slow-Down Blower) issued on Jan. 15, 1991 to M. J. Foreman and H. R. Greene and U.S. Pat. No. 3,711,038 (Pneumatic Tube System) issued on Jan. 16, 1973 to W. M. Van Otteren disclose such pneumatic systems.

SUMMARY OF INVENTION

The present invention contemplates a system for returning a bowling ball from a pit end of a bowling alley to an approach end of the bowling alley. Means are provided at the pit area to transport the bowling ball to an entrance end of an elongated, enclosed tube. The elongated tube has the entrance end near to the pit area and an exit end at the approach area, and has a bore sized to receive the bowling ball. Air flows through the elongated tube such that a vacuum is formed at the entrance end. The bowling ballis received at the entrance end and accelerated through the elongated tube toward the exit end. The exit end of the elongated tube is disposed such that the bowling ball is delivered to a conventional power lift, or alternatively delivers the ball to a transporter and deceleration assembly which relies upon the momentum of the ball through the tube to elevate the ball to the storage area.

In the pit area, a track system from two lanes delivers bowling balls from both lanes to the entrance end of the elongated tube. This track is inclined downward from the pit area to the elongated tube, and the tube extends along the floor between two lanes as in a typical return system. Alternatively, if greater lane densities are required, the return tube is installed underneath the lanes. This also permits the pin-setting equipment to be installed more closely together in the pit area.

The system includes means for forming an air flow from the entrance end of the elongated tube to the exit end is accomplished by inserting a conduit into the elongated tube near the exit end of the elongated tube and with a fan placed in the conduit and rotated such to cause the air to flow from the entrance end of the elongated tube toward the exit end. The rate of air flow is controlled by the selection of a desired horse power rating for the fan motor, by selecting a desired pitch for a fan blade, the speed of the fan, or a combination or these factors. By controlling the air flow, the acceleration and ultimately the speed of the bowling ball is controlled so that the bowling ball can roll to the exit end of the elongated tube at a desired rate of speed.

Unlike bowling balls being accelerated from the pit area to the lift along a track, bowling balls accelerated through the tube maintain an air cushion between the balls and do not stack up against each other during their transport through the elongated tube.

In one arrangement, the elongated tube works in conjunction with a lift tube to deliver the bowling ball directly to the ball storage rack, so that the need for the power lift is eliminated. The elongated tube has means for diverting the bowling ball to the lift tube, and a track which is placed in the elongated tube so as to divert the bowling ball as it rolls toward the exit end of the elongated tube. The diverted bowling ball passes through an opening in the top wall of the elongated tube or end of the elongated tube or top wall or end of a vacuum box into the entrance of the lift tube. The speed of the bowling ball is such to propel the ball up the lift tube and out the exit of the lift tube which is located so as to deposit the bowling ball into the ball storage rack. In a preferred embodiment, the ball is passed into a transporter and positive deceleration assembly located above the surface of the bowling alley and within the hood of a ball return shroud.

The present invention is also directed to a return shroud construction permitting the storage of a large number of bowling balls around the entire periphery of the shroud.

BRIEF DESCRIPTION OF DRAWINGS

The various embodiments of the invention are described with reference to the accompanying drawings in which:

FIG. 3 is a partial cross-sectional end view of an elongated tube illustrating the relationship of the bowling ball to the elongated tube bore;

FIG. 4 is a partial cross-sectional end view of track rails carrying the bowling ball;

FIG. 5 is a cross-sectional side view of a vacuum box containing a lift track receiving the bowling ball and delivering the bowling ball through an opening in the vacuum box having a flap and hinge arrangement;

FIG. 6 is an end view of the vacuum box receiving the elongated tube;

FIG. 7 is a cross-sectional top view of the vacuum box;

FIG. 8 is a cross-sectional side view of a motor and fan assembly affixed to the exit end of the elongated tube;

FIG. 9 is a partial cross-sectional elevation view of the approach end of the bowling alley showing a second embodiment of the invention using a power lift arrangement to deliver the bowling ball to a ball storage rack;

DETAILED DESCRIPTION OF PREFERRED EMBODIMENT

Figure 1:
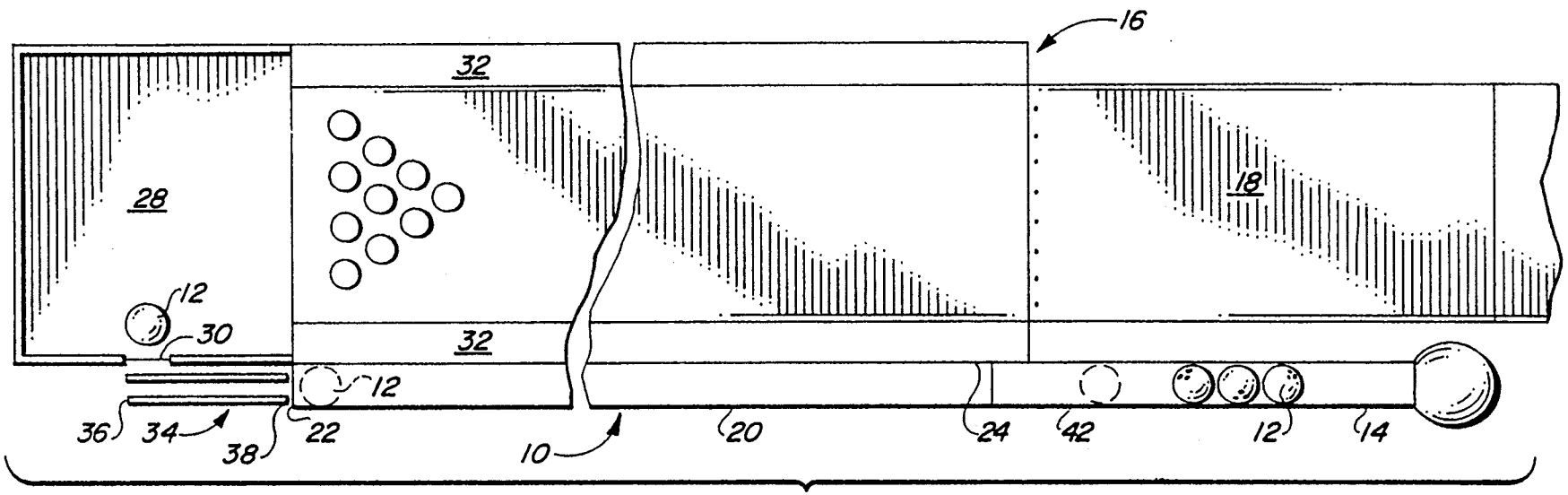
FIG. 1 is a partial top view of a bowling alley showing the position of the ball return apparatus relative to the pit area and approach area of the bowling alley.
Figure 2:
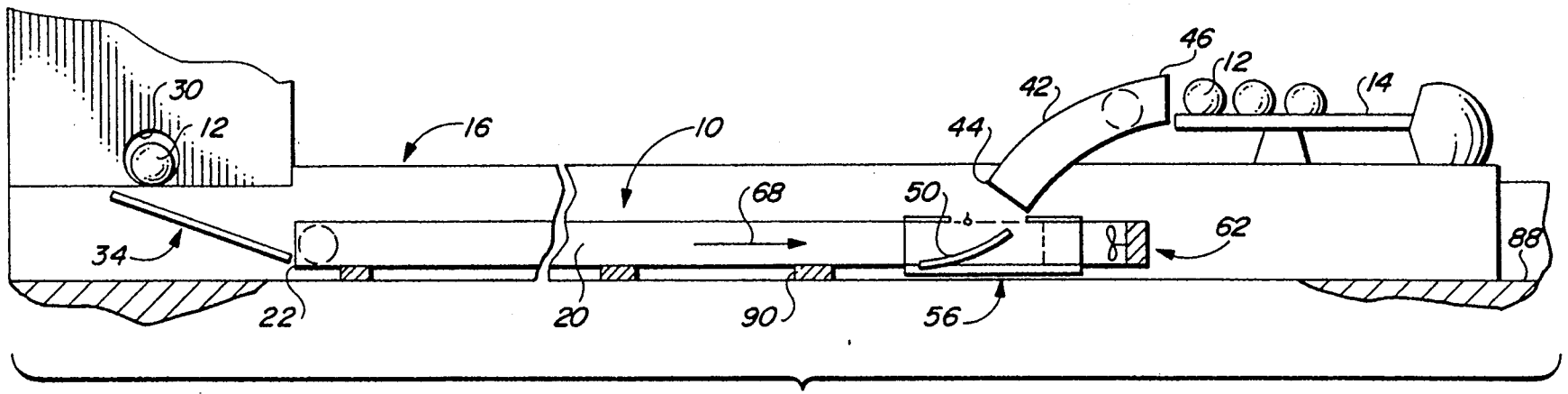
FIG. 2 is a partial cross-sectional elevation view of the bowling alley in which the preferred embodiment of the invention is illustrated.

A bowling ball return apparatus 10 in accordance with the present invention is described with reference to FIG. 1 and FIG. 2. As installed, the apparatus 10 receives a bowling ball 12 from the pit area 28 of a bowling alley 16 through a ball pit exit door 30 onto a track 34. The track first end 36 is adjacent to the ball pit exit door 30 and elevated above the track second end 38 which is adjacent to the entrance end 22 of an elongated tube 20. Track 34 having parallel rails 40 has long been used to transport spherical objects and especially bowling balls 12 as shown in FIG. 4. The elongated tube has the entrance end 22 in the vicinity of the pit area 28 and an exit end in the vicinity of an approach area 18 of the bowling alley. The bowling ball 12 is received at the track first end 36 and rolls down the inclined track 34 to the entrance end 22 of the elongated tube 20.

A motor and fan assembly 62 as shown in FIG. 8 is affixed in line or coaxially with the elongated tube 20 at the exit end 24 of the elongated tube 20. The fan 64 is rotated so as to create an air flow 68 from the entrance end 22 to the exit end 24 of the elongated tube 20. This air flow 68 forms a vacuum at the entrance end 22 of the elongated tube 20 where the bowling ball 12 is sucked into the elongated tube 20. The elongated tube 20 has a bore 26 shaped for closely receiving the bowling ball 12 as shown in FIG. 3. A regulated power supply 66 controls the speed of the motor and fan assembly 62 which in turn controls the air flow 68. The bowling ball 12 is accelerated through the elongated tube 20 toward the exit end 24 of the elongated tube 20. To protect the fan 64 from unwanted debris that may be sucked through the elongated tube 20, a screen 70 as shown in FIG. 8 is affixed between the fan 64 and the lift track 50.

A vacuum box 56 shown in FIG. 5, FIG. 6 and FIG. 7 is positioned at the exit end 24 of the elongated tube 20 and receives the elongated tube 20. The vacuum box 56 contains a lift track S0 with a first end 52 affixed so as to receive the bowling ball 12 as it leaves the exit end 24 of the elongated tube 20. The lift track 50 diverts the bowling ball 12 through an opening 48 in the top of the vacuum box 56 and toward an entrance end 44 of a lift tube 42. The momentum and thus speed of the ball is such that it rolls along the lift track 50 and through the lift tube 42 to the exit end 46 of the lift tube 42 where it is deposited into a ball storage rack 14 located above the approach area 18 floor elevation.

The level of the elongated tube 20 and relative positions of elongated tube and dependent elements is maintained using shims 90 located between the floor 88 and the elongated tube 20. To provide for a minimum loss of air flow 68 and a smooth ball speed control, a flap 58 is placed over the opening 48 in the vacuum box 56. The flap 58 is affixed along one end 60 to permit movement and allow the bowling ball 12 to pass from the lift track S0 to the lift tube entrance end 44. It is anticipated that the lift track 50 can be installed within the elongated tube 20 without the use of the vacuum box 56 by incorporating an opening 48 in the top of the elongated tube 20 at the position where the bowling ball 12 is to be ejected from the elongated tube 20 into the lift tube entrance end 44. A flap 58 affixed at one end 60 similar to that discussed above would be employed.

Figure 10:
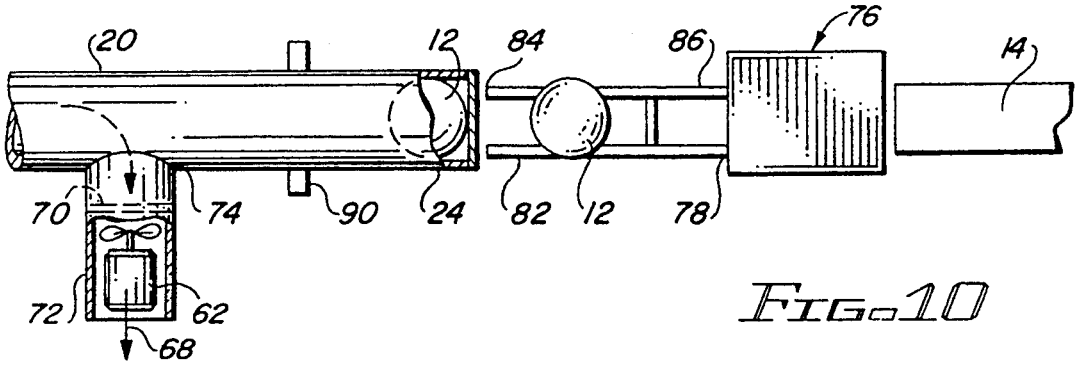
FIG. 10 is a partial cross-sectional top view of the second embodiment of the invention showing fan motor setup, track to the power lift and exit end of the elongated tube.

A second embodiment is anticipated when a partial replacement of a bowling ball return system is made in an existing bowling alley facility or when a bowling alley plans to incorporate existing power lift 76 equipment to carry the bowling ball 12 from a subway below the approach area 18 to the ball storage rack 14. FIG. 9 and FIG. 10 show a partial view of this second embodiment.

In this second embodiment for the invention, the exit end 24 of the elongated tube 20 terminates near an entrance end 78 of the power lift 76 placed on the floor 88. A power lift entrance track 82 is placed between the exit end on the elongated tube 20 and the power lift entrance end 78 such that the bowling ball 12 is received at the exit end 24 of the elongated tube 20 by a first end 84 of the power lift entrance track 82 and accelerated toward the exit end 80 of the power lift entrance track 82 affixed so as to allow the bowing ball 12 to be accepted by the power lift 76 at its entrance end 78. Refer to FIG. 9.

The bowling ball 12 is transported from the pit area 28 toward the exit end 24 of the elongated tube 20 as it is in the preferred embodiment. See FIG. I and FIG. 2. However, in the second embodiment, the air flow 68 used to accelerate the bowling ball 12 is created with a motor and fan assembly 62 located near the exit end 24 but between the exit end 24 and the entrance end 22 of the elongated tube 20. A conduit 72 is affixed to a side wall 74 of the elongated tube 20 in the proximity of but not at the exit end 24 of the elongated tube 20. The motor and fan assembly 62 is affixed inline to the conduit 72 with the rotation of the fan 64 such that the air flow 68 accelerates the bowling ball 12 from the entrance end 22 of the elongated tube 20 toward the exit end 24 and out the conduit 72.

The exit end 24 of the elongated tube 20 is closed using a flap 58. The flap 58 is sized larger than the elongated tube bore 26 and affixed at the top of the elongated tube 20. The bowling ball 12 rolls out the exit end 24 of the elongated tube 20 by pushing against the outwardly hinged flap 58. The direction of the air flow 68 out the side wall 74 of the elongated tube 20 and through the conduit 72 causes a partial vacuum at the hinged flap 58. This partial vacuum acts as a cushion for the rolling bowling ball 12 and provides the needed braking for the bowling ball 12 before it ejects from the elongated tube 20. The rotation of the motor and fan assembly 62 is controlled from a variable power supply 66 as in the preferred embodiment. In the case of the second embodiment, the distance between the exit end 24 of the elongated tube 20 and the conduit 72 location in the side wall 74 is also used in establishing the speed of the bowling ball 12 and in particular the speed with which it leaves the exit end 24 of the elongated tube 20.

The invention discloses the apparatus used to deliver a bowling ball 12 from its useless place in a bowling alley 16 pit area 28 to the ball storage rack 14 where a bowler can retrieve it for the next attempt at his sport, bowling.

Figure 11:
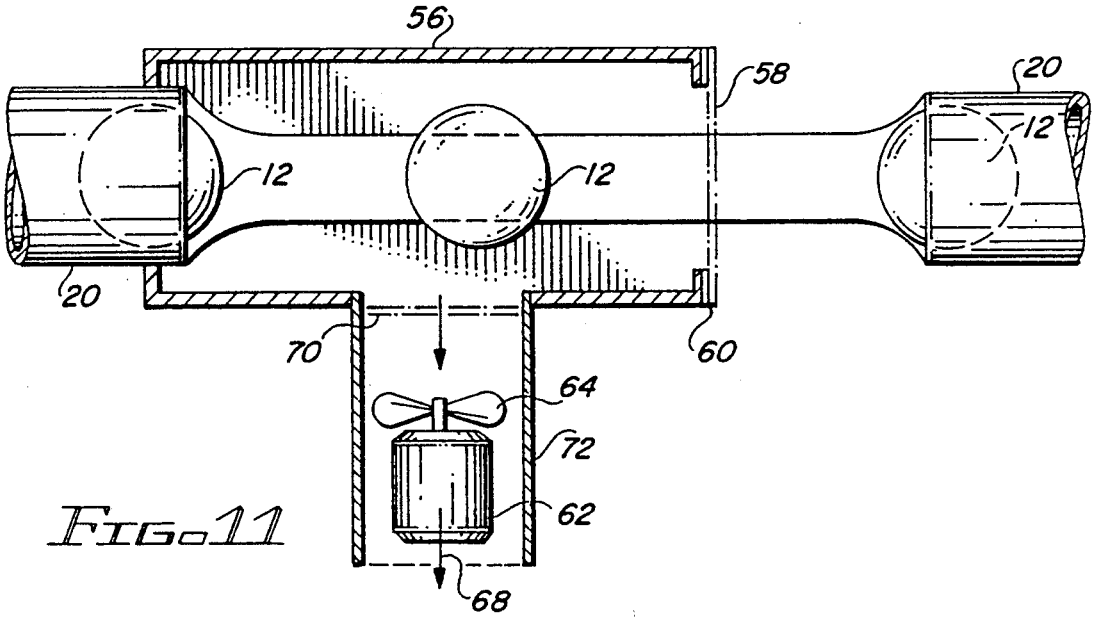
FIG. 11 is a partial cross-sectional top view of another vacuum box embodiment showing the use of a partial section of the elongated tube used to replace the track and the fan motor assembly affixed to the vacuum box.
Figure 12:
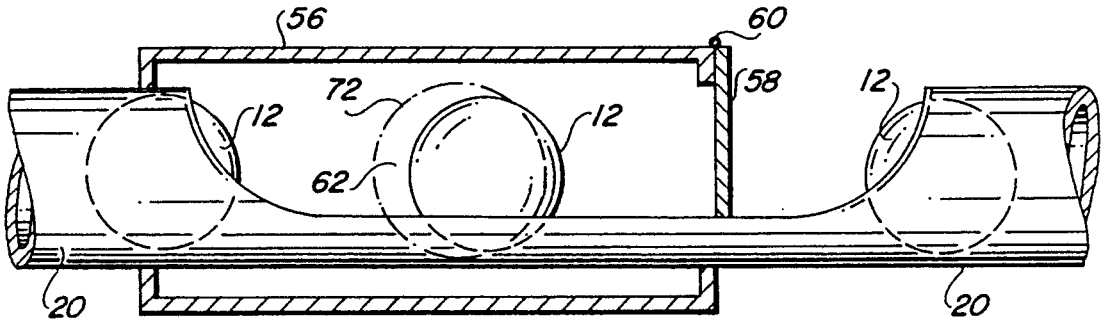
FIG. 12 is a partial cross-sectional side view of the vacuum box showing the cutaway elongated tube used in place of track and the use of a flap at an exit to the vacuum box.

Two embodiments have been disclosed for the bowling ball return. Variations within each embodiment are anticipated. One such variation includes using the elongated tube 20, the vacuum box 56 and the motor and fan assembly 62 in a combined configuration. FIG 11 illustrates this configuration. The elongated tube 20 having a full bore 26 penetrates an end wall of the vacuum box 56. Inside the vacuum box 56, the elongated tube 20 is partially cut along the tube wall in such a way to keep the bottom of the tube wall in place and remove the sides and top of the tube wall. The bowling ball 12 will roll uninterrupted from the full bore to the cut tube through the vacuum box and leave out an exit end of the vacuum box. The motor and fan assembly 62 is affixed to the side wall of the vacuum box rather than the exit end of the vacuum as described earlier. Air flow 68 is established at a desired level based on the location of this vacuum box configuration with respect to the power lift 76 or the lift tube 42 in the embodiments disclosed. A flap 58 is affixed to the exit end of the vacuum box 60 for efficient air flow control. The partially cut elongated tube is extended outside the vacuum box. Once outside the vacuum box 56, the elongated tube 20 is returned to a full bore condition to allow the bowling ball 12 to be directed as desired to a lift tube 42 or to a power lift 76 as described. FIG. 11 and FIG. 12 illustrate the use of this vacuum box embodiment.

The use of the vacuum return system described above permits special benefits to be recognized in the pit area at the end of a bowling alley, as is described next with reference to FIGS. 13 and 14.

Figure 13:
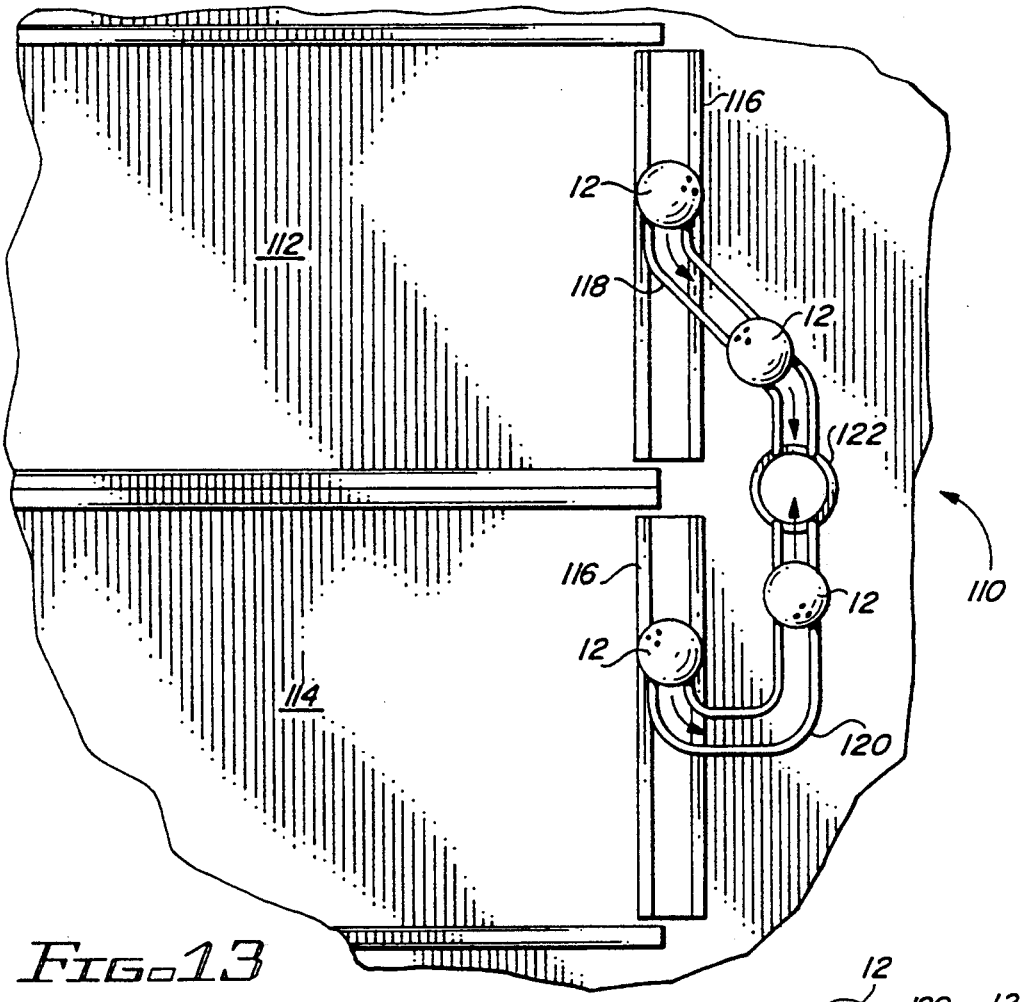
FIG. 13 is a top view illustrating a portion of a system for feeding bowling balls into the vacuum tube arrangement of FIGS. 1–12.
Figure 14:
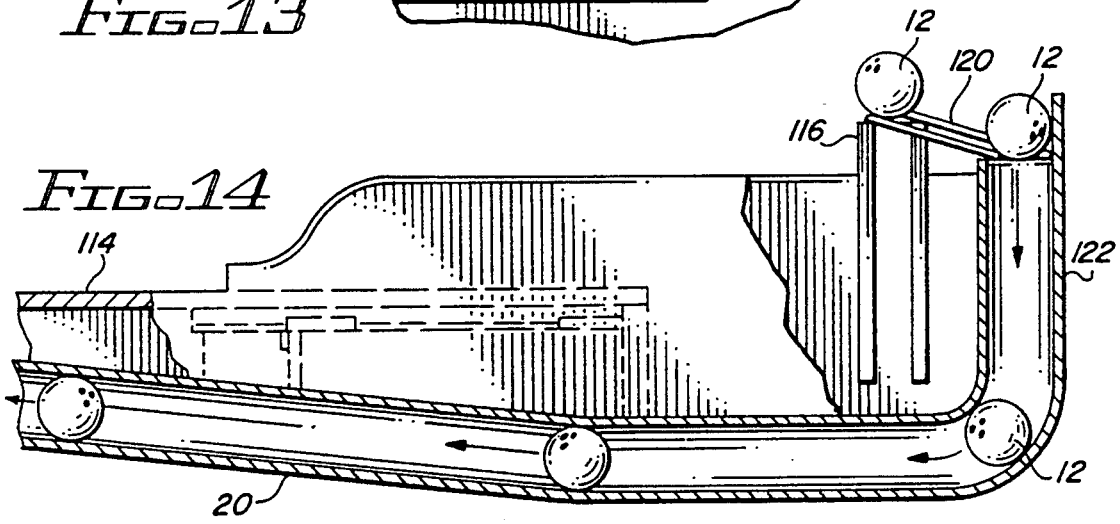
FIG. 14 is a side view of the arrangement of FIG. 13.

In FIGS. 13 and 14, the construction of a pit area 110 of a pair of bowling alleys 112, 114 is shown. In the past, it was conventional to employ a covered return lane between a pair of alleys, with bowling balls being fed into the return lane from the pin setting equipment. In accordance with the construction set out in FIGS. 13 and 14, the pin setting equipment 116 is disposed in a more closely positioned relationship between adjacent alleys 112, 114 than has heretofore been done in the past. In order to feed bowling balls 12 back to the storage rack in the approached area, the adjacent alleys 112, 114 are provided with corresponding rail systems 118, 120 which feed the bowling balls from the top of the pin setting equipment 116 and into a vertical tube 122 located behind both pin setters 116 in the pit area. Noting FIG. 14, bowling balls are then dropped down the vertical tube 122, around a curve and into the vacuum tube 20, for transportation back to the storage rack in the approach area, with the tube 20 extending underneath the alleys 112, 114, rather than between them as has been done in the past. It will be appreciated that this construction permits a greater density of bowling alleys than has been achieved in the past.

Figure 17:
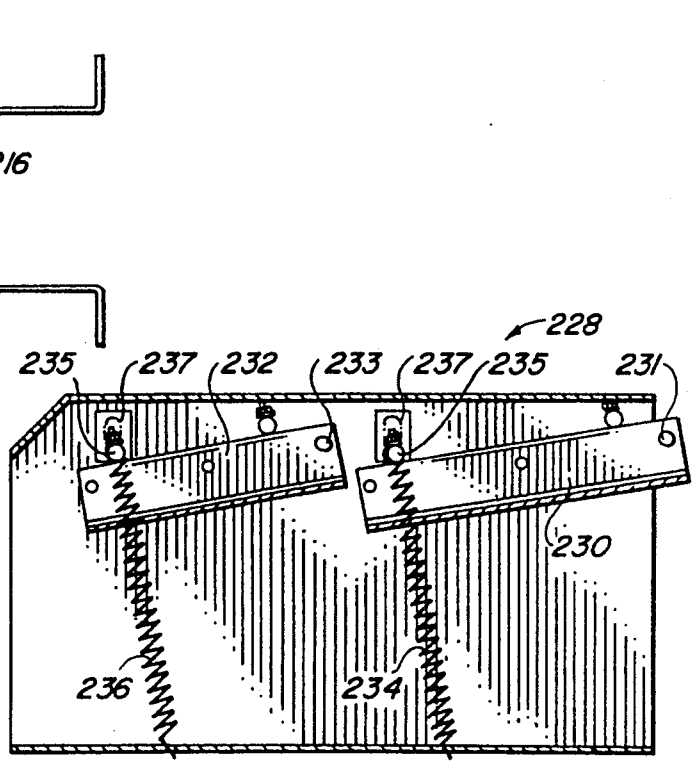
FIG. 17 is a side view, partially cut away, of a brake plate housing useful with the transporter system of FIG. 15.
Figure 16:
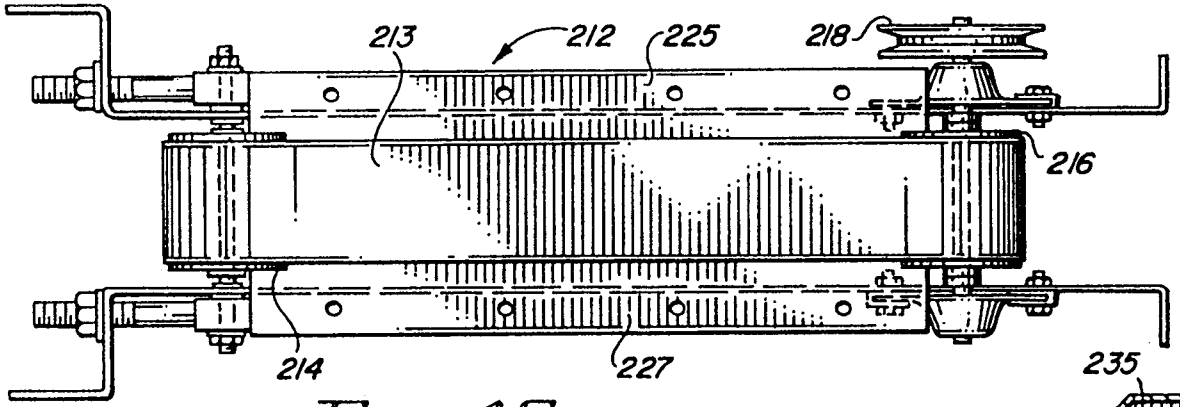
FIG. 16 is a top view of a conveyor sub-assembly useful with the transporter system shown in FIG. 15.
Figure 15:
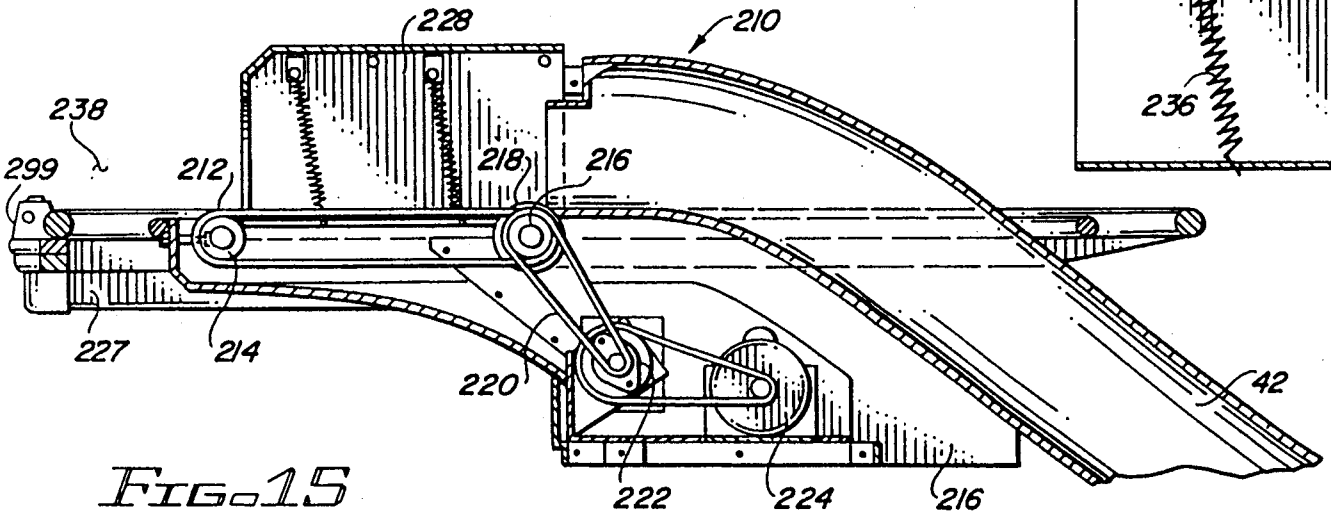
FIG. 15 is a side view, partially cut away, of an alternate transporter system for use with the vacuum return system described with reference to FIGS. 1–12.

Another technique for delivering the bowling ball from the lift tube 42 to the storage area will now be described with reference to FIGS. 15–17.

Noting FIG. 15, there is provided a transporter assembly 210 which is enclosed within a shroud 240, which shroud is omitted in FIGS. 15–17 and described in detail below with reference to FIGS. 18–20. The transporter assembly 210 includes a conveyor sub-assembly 212 consisting of a conveyor belt 213 carried by spaced rollers 214, 216 with the second roller 216 serving as a drive roller operated from a drive wheel 218 engaged by a belt 220. The belt 220, in turn, is driven by motor 224 through gear reduction sub-assembly 222. The entire conveyor assembly 212 is supported at the exit end of the lift tube 42 by a brace 226 and frame members 225 and 227. Also located at the exit end of the lift tube 42 is a brake support housing 228 which is shown in specific detail in FIG. 17. The brake support housing 228 includes first and second brake plates 230, 232 which are respectively pivoted to the housing at pivot points 231 and 233. Each brake plate 230, 232 includes a cross-rod 235 which is restricted in movement by a slot 237 on opposite sides of the housing 228. Each brake plate 230, 232 is held downwardly against the bottom of the slot 237 by a corresponding spring 234, 236 fastened at one end to the cross-rod 235 and at the other end to the bottom of the housing 228. Preferably, each brake plate 230, 232 has a soft, friction-type material (such as leather) along the face of the brake plate.

In operation, bowling balls 12 are directed through the lift tube 42 and out of its exit end onto the conveyor 213. By way of example, it is not uncommon for the bowling balls 12 to be moving at a rate of about 20 miles per hour at the exit end of tube 42. Immediately upon exiting the tube, the bowling balls are directed by the first brake plate 230 against the surface of the conveyor 213, which is operating at a much slower speed but in the direction toward the exit end of the brake housing 228. The first brake plate 230 has the effect of rapidly slowing down the bowling ball, without marring or scratching the surface of the ball. The second brake plate 232 insures that the bowling ball is travelling across the conveyor only at the speed of the conveyor, so that the ball has lost all of its momentum. The ball then passes through the exit opening of the brake housing 228 and into the ball delivery area 238 (FIG. 15) of the storage area.

A novel form of a shroud and storage rack for bowling balls is shown and described with reference to FIGS. 18–21.

Figure 18:
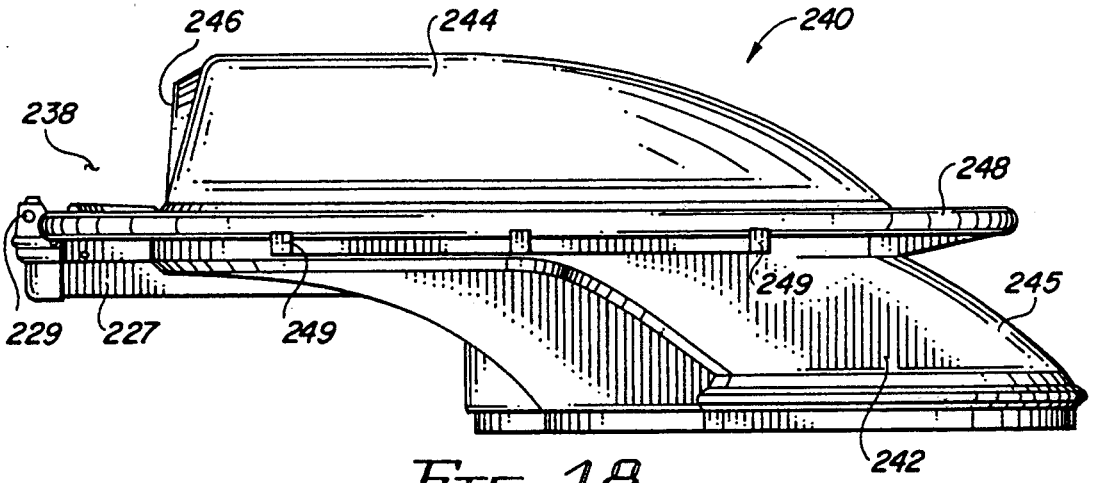
FIGS. 18, 19, and 20 are side, top and front views, respectively, of a storage shroud useful with the bowling ball return system of the present invention.
Figure 19:
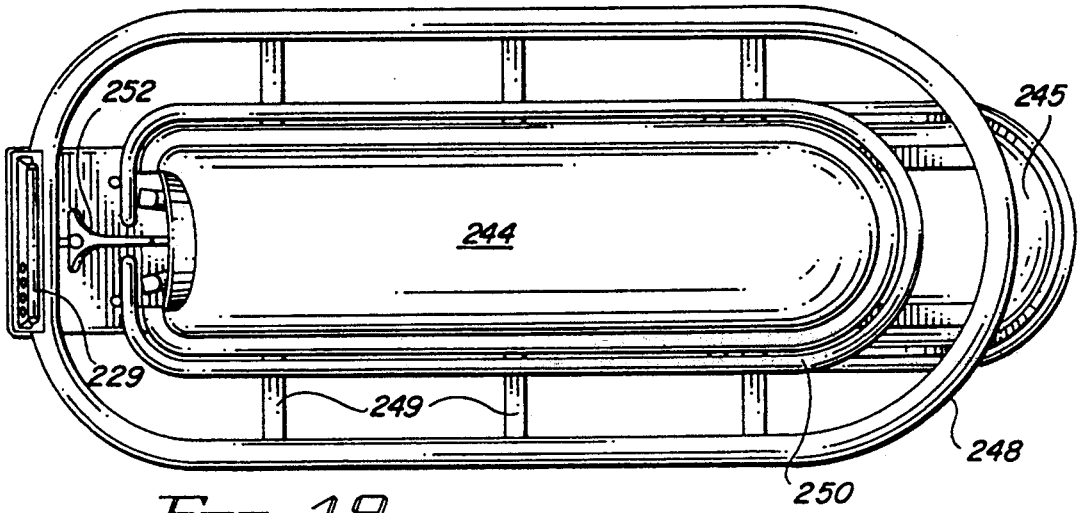
Figure 20:
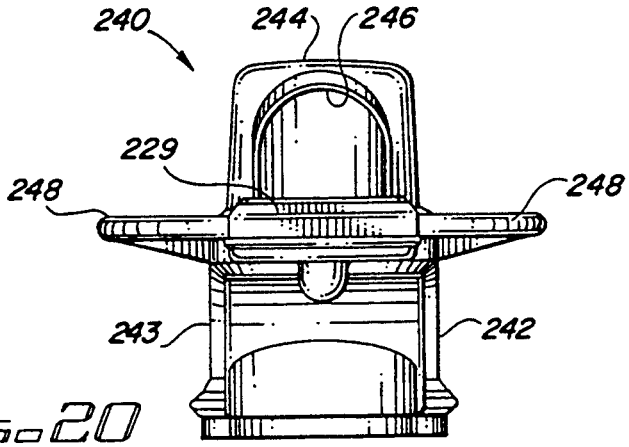

The novel shroud assembly 240 of FIGS. 18–20 includes a bottom shroud portion 242, which extends continuously in a curved pattern to the rear of the shroud 245, and thence along the opposite side 243. A removable shroud cover 244 extends over the exit end of the lift tube 42, the conveyor subassembly 212 and the brake housing 228 and includes an exit opening 246 for directing bowling balls into the delivery area 238. A bumper 29 and triangular shaped director 252 are employed in the ball delivery area 238 to stop the forward direction of the bowling ball leaving opening 246, and in order to direct the bowling balls onto an encircling rail system. The rail system comprises an outer rail 248 supported by stanchions 249 and an inner rail 250. As will be appreciated from FIG. 19, the rail system extends continuously around the shroud 240, thus permitting a storage on the order of 17 bowling balls. As is depicted in FIG. 20, the rearward portion of rail 248 extends slightly below the level of that rail at the ball delivery area 238, in order to facilitate the rolling of the balls rearwardly about the shroud 240.

Figure 21:
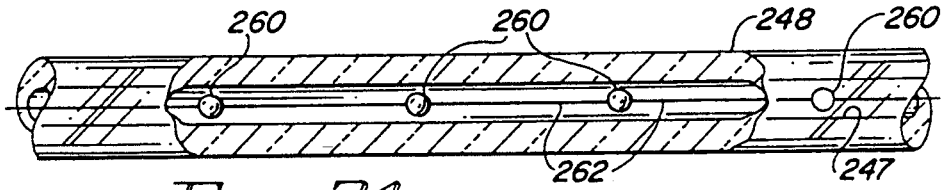
FIG. 21 illustrates a method of providing interior illumination to translucent rails used with the shroud and storage system depicted in FIGS. 18–20.

As is shown in FIG. 21, it is preferred that at least the outer rail 248 be fabricated from a translucent material having a slot 247 along its bottom portion, with a string of light emitting diodes or other lighting means 260 with appropriate circuitry 262 extending through the slot 247, in order to illuminate the rail 248. The rail 250 may likewise be provided with similar lighting.

This concludes the description of the preferred embodiments. A reading by those skilled in the art will bring to mind various changes without departing from the spirit and scope of the invention. It is intended, however, that the invention only be limited by the following appended claims.

What is claimed is:

1. A system for returning a bowling ball from a pit end of a bowling alley to an approach end of the bowling alley, comprising:

a bowling alley having an approach end and a pit end and bowling balls useful for rolling the alley from the approach end to the pit end;

an elongated tube having a bore extending therethrough, the tube having an entrance end adjacent the pit end and an exit end adjacent the approach end with the bore shaped and dimensioned for closely receiving the bowling balls at the entrance end and passing them to the exit end;

means adjacent the exit end for forminq a vacuum at the entrance end for sucking the bowling balls into the entrance end of the tube and for accelerating the bowling balls out of the exit end; and means adjacent the exit end for positively decelerating each bowling ball passing therethrough.

2. The system recited in claim 1 wherein the deceleration means comprises:

an elongated conveyor adjacent the exit end of the tube for contacting each bowling ball;

means for moving the conveyor at a speed substantially less than that of the bowling balls for deceleration; and means for pressing each ball against the conveyor during a portion of ball travel along the conveyor.

3. The system recited in claim 2 wherein the conveyor moving means comprises means for rotating the conveyor in the direction of ball travel through the tube.

4. The system recited in claim 3 wherein the pressing means comprises a spring-loaded pressure plate opposite the conveyor adjacent the exit end.

5. The system recited in claim 4 wherein the pressing means further comprises a second spring-loaded pressure plate opposite the conveyor and downstream of the first pressure plate.

6. The bowling alley construction recited in claim 1 further comprising low friction track means within the tube for supporting bowling balls travelling therethrough.

7. A method for returning a bowling ball from a pit end of a bowling alley to an approach end of the bowling alley comprising the steps of:

providing a bowling alley with an approach end and a pit end and bowling balls useful for rolling along the alley from the approach end to the pit end, and further providing an elongated tube having a bore extending therethrough, the tube having an entrance end and an exit end with the bore being shaped and dimensioned for closely receiving bowling balls at the entrance end and passing the bowling balls to the exit end;

positioning the entrance end of the tube adjacent the pit end of the bowling alley and the exit end adjacent the approach end of the bowlinq alley;

forming a vacuum in the elongated tube from a point adjacent the exit end for sucking the bowling balls into the entrance end of the tube and accelerating the bowling balls out of the exit end; and positively decelerating each bowling ball as it passes adjacent the exit end.

8. In a bowling location having plural bowling alleys each of which has a pit area and pin-setting equipment in the pit area and an approach area at an end opposite from the corresponding pit area, a method for constructing a ball return for the plural alleys, the construction method comprising the steps of:

installing a ball return tube below the bowling alleys;

delivering bowling balls from the pit area of each alley into the return tube; and applying a suction in the ball return tube to draw bowling balls through the tube and provide sufficient momentum to move the bowling balls upwardly to the level of the bowling alleys to the approach area.

9. The method recited in claim 8 further comprising the steps of:

installing a vertical tube behind the pin setting equipment; and feeding bowling balls from the pin-setting equipment rearwardly into the vertical tube.

10. The method recited in claim 10 wherein the feeding step comprises:

installing railings at an upper extremity of the pin-setting equipment; and passing the bowling balls from the pin-setting equipment onto the railings.

11. A bowling alley construction comprising:

plural, parallel bowling alleys each of which has a pit area and pin-setting equipment in the pit area;

each alley defining a generally horizontal plane and having an approach area at one end and a pit area at the other end;

pin-setting equipment installed in the pit area of each bowling alley;

a ball return tube installed below the bowling alley;

means for delivering bowling balls from the pinsetting equipment in the pit area into the return tube below the plane of the bowling alley; and means for applying a suction in the ball return tube to draw bowling balls through the tube.

12. The bowling alley construction recited in claim 11 wherein the suction applying means is positioned along the return tube adjacent the approach end of the corresponding alley.

* * * * *